United States Patent [19]

Nicol

[11] 4,082,049

[45] Apr. 4, 1978

[54] SAILING CRADLE

[76] Inventor: Henry A. Nicol, 5210 Roundmeadow Rd., Hidden Hills, Calif. 91302

[21] Appl. No.: 748,525

[22] Filed: Dec. 8, 1976

[51] Int. Cl.[2] ..... B63B 35/00

[52] U.S. Cl. ..... 114/39; 9/2 A

[58] Field of Search ..... 9/1.1, 1.7, 2 R, 2 C, 9/2 A, 11 A; 114/39, 102, 218

[56] References Cited

U.S. PATENT DOCUMENTS

| | | | |
|---|---|---|---|
| 3,041,994 | 7/1962 | Brodie | 114/39 |
| 3,601,076 | 8/1971 | Meeks | 114/39 |
| 3,770,244 | 11/1973 | McCloud | 114/218 |
| 3,839,979 | 10/1974 | Wassell | 114/39 |

FOREIGN PATENT DOCUMENTS

| | | | |
|---|---|---|---|
| 1,186,357 | 1/1965 | Germany | 9/11 A |
| 16,566 | 12/1955 | Germany | 9/2 A |
| 365,622 | 12/1962 | Switzerland | 9/2 A |
| 576,561 | 4/1946 | United Kingdom | 9/2 A |

*Primary Examiner*—Trygve M. Blix
*Assistant Examiner*—Jesus D. Sotelo
*Attorney, Agent, or Firm*—Kleinberg, Morganstern, Scholnick & Mann

[57] ABSTRACT

A sailing frame is disclosed which, in the preferred embodiment, is adapted to mount on an inflatable boat. The frame can be disassembled and/or folded into a small package for storage, compatible with the deflated boat. The frame assembles into a rigid configuration which mounts on the gunwales of the inflatable boat. Mounting members for a collapsible mast and sails are provided. The frame can include a mounting for a rudder. The sailing frame includes a pair of vertically extending dagger or bilge boards which, in the water, provide fore and aft stability to the boat and resist lateral forces. In alternative embodiments, the frame can be mounted on any other small boat or dinghy, and, when not in use, can be disassembled and stowed.

14 Claims, 15 Drawing Figures

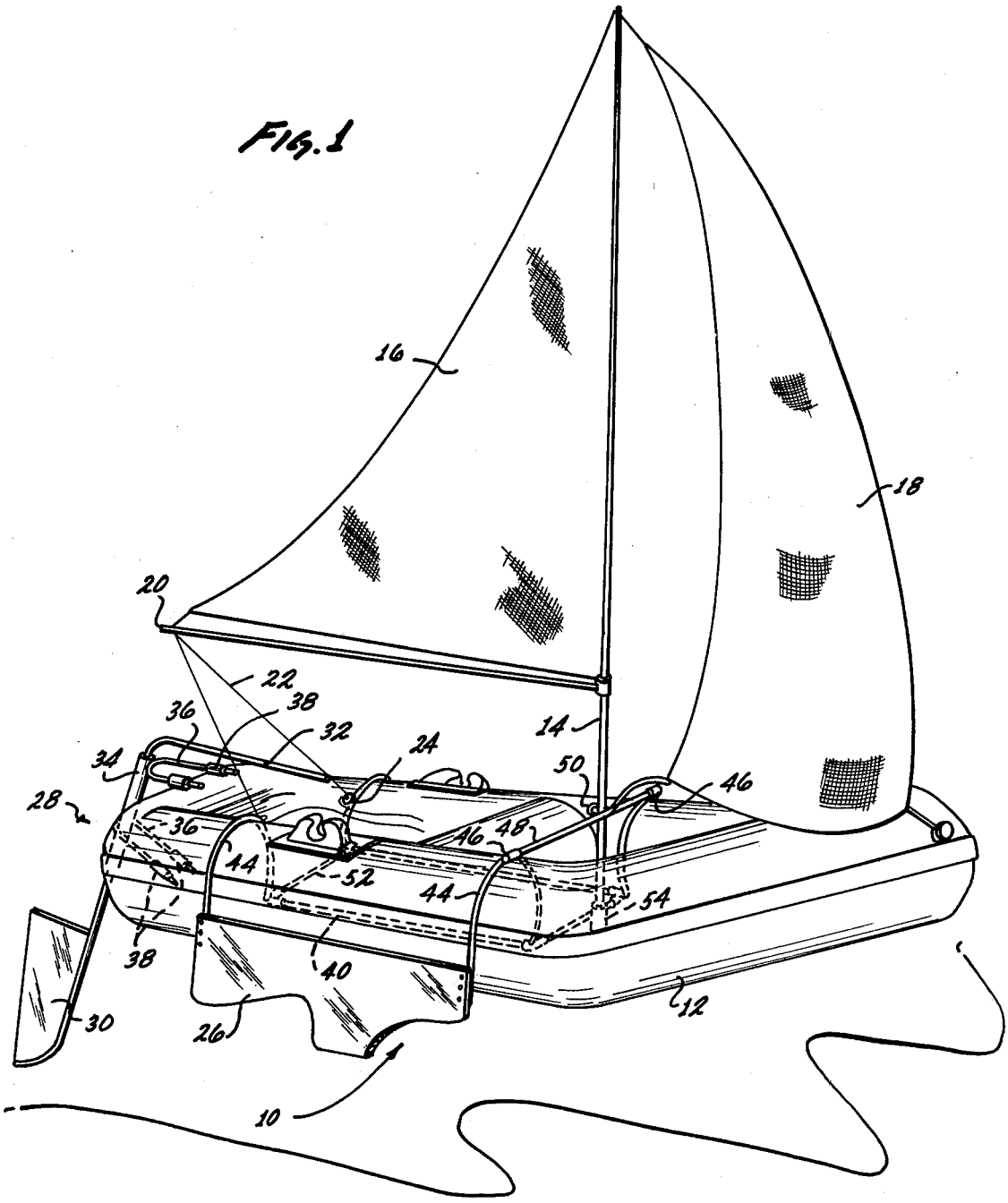
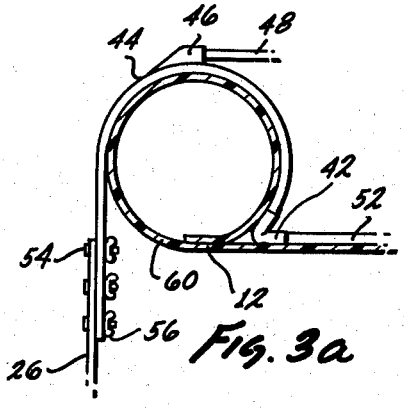
FIG. 3a
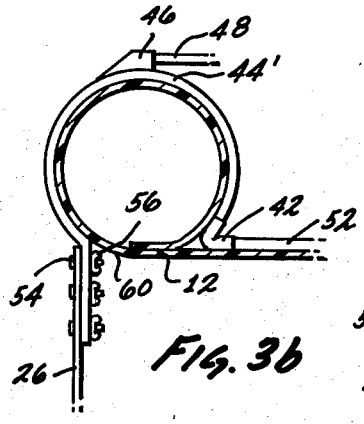
FIG. 3b
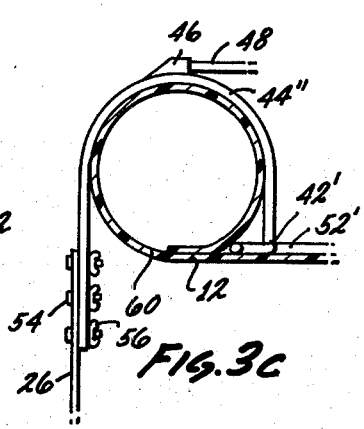
FIG. 3c 344
346
350
300
340
366
326
348
354
344
364
366
366
344
364
362
360
326
366

374
372
376
134
370
378

380

382
380

SAILING CRADLE

BACKGROUND OF THE INVENTION

The present invention relates to sail boats and, more particularly, to a sailing frame that is adapted to be mounted on a floating, buoyant hull structure.

It has long been known that most boats can be converted to sail boats by the addition of an apppropriate mast structure to support a sail and by the addition of appropriate stabilizing fins or boards which extend below the water line to impart a certain fore and aft stability to the boat to provide some slight increase in the resistance of the boat to rotation about the longitudinal axis.

Conventionally, when one starts with a rigid hull, one finds ample structural support for the addition of the mast and the stabilizing fins. Mast can be supported by a keel or, where absent, by the relatively rigid sole of the boat, while the gunwales provide points of attachment for stays which can support the mast upright through tension.

Either center boards or dagger boards are readily mounted and find adequate points of attachment on the structure. Even canoes can be fitted with a kit that includes a pair of lee boards and a central member joining the lee boards which includes a mast mount for supporting a mast structure. A rudder assembly, when added, adapts the canoe for sailing.

Since the 1940's, inflatable boats have achieved more and more popularity. These inflatable boats, which during the war were utilized as life rafts or as dinghies have been improved and developed to the point where they are currently being sold, for example, by Avon Inflatables, Limited, of Great Britain. The Avon catalog includes dinghies in sizes from 8 feet to 12 feet in length; sport boats which are adapted to operate with outboard motors, as well as rigid inflatables, which include a fiber glass rigid hull. The sport boats range in length from 9 feet to 16 feet and the rigid hull versions range from 13 to almost 18 feet.

A common feature shared by the inflatables is the substantially planar sole or floor which is made of a fluid impermeable flexible sheet. In a better inflatables, a plastic impregnated fabric is used, while less sturdy versions utilize a heavy guage film such as P.V.C. A substantially cylindrical inflation tube provides buoyancy and also serves as the "hull" of the craft. The buoyancy tubes can be fitted with oar locks, outboard beckets and life lines. The buoyancy tubes can be subdivided or compartmentalized for safety so that a rupture need not cause the loss of all buoyancy.

Another feature of the inflatable boats in their substantial resistance to capsizing, resulting from rotation about a longitudinal axis. Further, due to the wide beam and low center of gravity, the boats are extremely stable.

The very flat bottom of the inflatable, while of great benefit in assuring stability and resistance to capsizing does subject the boat to "skidding" under the force of the winds or waves. This tends to make rowing slightly more difficult since the craft is very sensitive to unequal application of propelling forces by the oars.

Because the inflatable is not rigid and, on the contrary, is resilient and flexible, no serious efforts have been made to adapt the craft for sail. Therefore, sailing for pleasure creates an additional category of uses for inflatables.

Inflatable boats have also achieved widespread acceptance and distribution as life rafts for aircraft and marine vessels. In such cases, they are compact, easily stored, easily deployed and, using compressed gas cylinders, easily inflated. In recent years, inflatables used as life rafts have been modified to a circular or polygonal shape and have been fitted with all types of survival gear. However, as noted above, such a structure is not easily propelled or directed and, in use, would generally drift aimlessly at the mercy of the winds, waves, and prevailing currents.

Oars or paddles can be employed for limited, directed movement. Sea anchors can limit the drift due to wind, while sails can accentuate the effect of the wind and minimize the drift due to waves and current.

With a suitable sailing adaptation, the wind could be utilized to propel the craft on a reasonably predictable course and the crudest or navigational instruments would permit progress in a desired direction, without the physical exertion required by rowing.

Frequently, occupants of a life raft do have an idea of their location and the ability to navigate. Under such circumstances, it would be highly desirable to have the capability of directed progress toward a destination whether it be land, a well-travelled shipping lane, or an airline route. Accordingly, a sailing "kit" adapting the raft to be sailed would be an invaluable addition to the raft itself.

SUMMARY

According to the present invention, a disassemblable sailing frame is provided which is adapted to mount upon and be supported by the buoyancy tubes of the inflatable boat. Connecting members at floor and gunwale height combine to provide a mast support structure which is of sufficient structural stability so as not to require the use of tensioned stays.

Bilge boards, which are integral to the assembled frame, extend fore and aft from a point just below the water line so as not to interfere with the life lines which may be mounted. A rudder assembly is provided which is adapted to mount in the outboard member beckets, and which provides a tiller or sweep with which the vessel can be steered by a person in the boat. In one embodiment, a staysail or jib can be mounted between the top of the mast and the bow to take additional advantage of whatever winds are available.

In the preferred embodiment, the sailing frame includes mounting members which can be of tubular pipe, bent in almost a complete circle, extending approximately through 225° of arc. On the interior, the mounting member curves to the point at which the floor or sole is attached to the buoyancy tube. Fore and aft members also attach, which, in combination with cross members, provide a substantially rectangular frame in the floor of the boat. The forward cross member is also fitted with a mast receiving cylinder or cup. An upper cross member is mounted in parallel with an appropriate guide member to support the mast.

A collapsible mast structure may be used which may include two or three telescoping mast sections so that the entire mast need be no longer than the longest, disassembled strut. The bilge boards can either be permanently mounted to the curved mounting members or can include tubular members which are adapted to be inserted into the mounting members and pinned in place or may be mounted with removable fasteners. Obviously, depending upon the size of the boat for which the frame is intended, the degree to which the frame can be disassembled is a matter of design choice and the relative portability of the largest component.

To ready the boat for sailing, the sailing frame is first assembled in place. The curved mounting members are set up and mounted to the rectangular frame members. The upper cross member is installed and the whole frame is set atop a deflated boat. The boat is then partially inflated and the interior rectangular frame is positioned on the sole or floor of the boat in the desired location. The buoyancy tubes are partly inflated and positioned inside the encircling curved support members. The boat is then completely inflated and the buoyancy tubes will then expand within the surrounding frame members so that, once inflated, the frame and the boat are not readily separable.

The mast can then be assembled and installed in the mast step provided. If preferred, the bilge boards can be inserted into the support members and pinned in place. The rudder assembly is next added to the stern. The outboard motor brackets or beckets, which are integral with the inflatable boat, can be adapted to receive a pair of substantially semicircular or U-shaped rudder support members which include a vertical tube into which a rudder member can be fitted and to which is mounted a pillar member. Appropriate pins and keys can prevent the elements from becoming inadvertently disassembled. The normal outboard motor bracket for the inflatable tends to include an appropriate member for accepting the rudder assembly support members.

The after curved members include appropriate sheaves and pulleys which fasten to sheets, or lines, from the boom so that the position of the sail relative to the wind direction can be fixed from a position in the cockpit and controlled manually.

In other embodiments, the rigid sailing frame or cradle can be adapted for use with non-inflatable boats such as wooden, fiberglass or aluminum dinghies, rowboats, or flatbottomed skiffs. In such embodiments, the only major modification to the craddle or frame is that the curved members which normally enclose the buoyancy tubes would be shaped to adapt to the inner surface of the hull and would include meams for clamping to the gunwale to prevent relative movement between the frame and the hull.

In yet other embodiments, adapted for substantially circular or polygonal life rafts, the frame members can be made to fit the circular configuration of the raft. In this embodiment, the buoyancy tube enclosing curved members could extend below the water line and the bilge boards would then represent the chords of an arc, thereby establishing a preferred longitudinal sailing axis for the raft.

DESCRIPTION OF DRAWINGS

FIG. 1 is a perspective view of an assembled sailing frame or cradle of the present invention, mounted on an inflatable boat;

FIG. 3 including FIGS. *3a*, *3b*, and *3c* are side sectional views of three alternative embodiments of the sailing cradle in which the curved attaching member includes approximately 225° of arc, 270°, and 180° respectively;

DESCRIPTION OF THE PREFERRED EMBODIMENT

Figure 2:
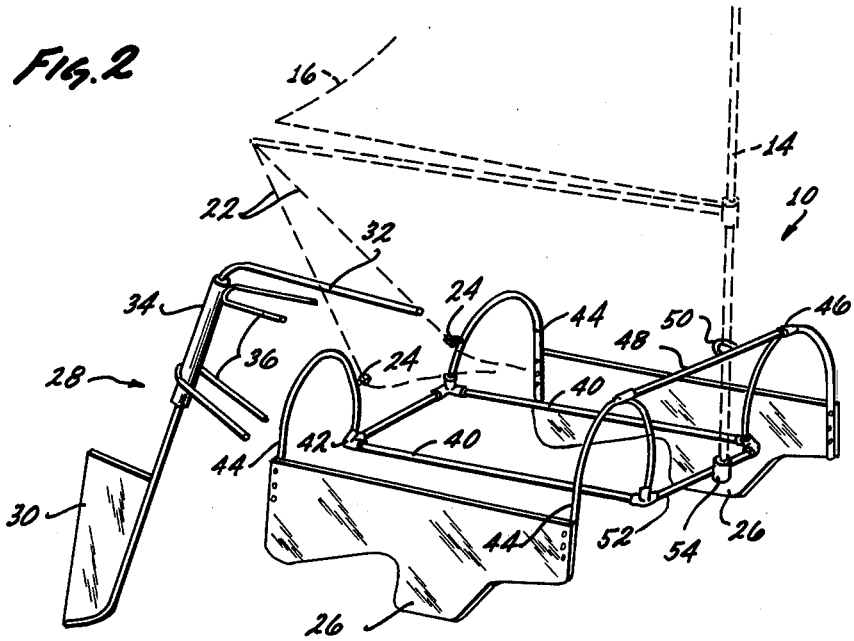
FIG. 2 is a perspective view of the sailing cradle of FIG. 1, assembled but without the boat.

Turning first to FIG. 1, there is shown an assembled sailing cradle 10 mounted on an inflatable boat 12. The cradle 10 is shown fully rigged for sailing and includes a mast 14, mainsail 16, and a staysail 18. A boom 20 is fitted to the mast 14 and is connected by lines 22 running through blocks 24 to be used by the sailor of the combination.

A pair of lee or bilge boards 26 extend below the water line and afford directional stability to the assembled craft. A rudder assembly 28 include a rudder member 30 and a tiller portion 32 which is mounted in a tube 34 that is adapted through a pair of U-shaped members 36 to frictionally engage the motor mounting beckets 38, which are generally fitted by the manufacturer of the inflatable raft. The bilge boards 26 and the rudder may be adapted to fold in use so that the boat can be beached. This requires only hinged fittings in place of those illustrated.

Turning next to FIG. 2, which better illustrates the sailing frame or cradle 10, without the inflatable boat 12, it is seen that the craddle's structural integrity is established by a retangular framework of struts 40 which are interconnected using corner members 42. At each of the corners there is curved mounting member 44 arranged to enclose the inflatable buoyancy tube portion or gunwale portion of the boat 12.

The forward curved members 44 include a coupling 46 for a stiffening strut member 48 which includes a guide element 50 to support the mast 14. The lower, forward, cross-beam strut 52 includes a mast cylinder or cup 54, in which the mast 14 is carried to avoid any contact with flexible floor of the boat 12.

The longitudinal struts 40 connect the curved members 44 on the sides of the boat 12. The curved members 44, at their remote or outboard ends, are fastened together by the bilge boards 26. When fully assembled, the frame or cradle 10 is substantially rigid and has sufficient structural integrity to accommodate all the stresses that sailing would impose upon the frame. The inflatable craft 12 supplies the necessary buoyancy to keep the sailing frame 10 afloat. The weight of the frame 10 is substantially borne by the buoyancy tubes. As can be seen from FIG. 2, the sailing frame 10 is disassemblable into a kit of parts which include the five strut members, the four curved members 44 and the bilge boards 26, the mast 14, the boom 20, and the sails. Similarly, the rudder assembly 28 in combination with the inflatable craft 12, affords a degree of control to the combination and is also disassemblable into the component parts of rudder 30, mounting tube 34 and tiller 32. The U-shaped brackets 36 can be an integral part of the tube 34 or may be removably attached thereto.

The entire kit of parts, except for perhaps the mast 14 and the boom 20, can be stored in a carrier that need not be much larger than the carrier which is used to transport the deflated boat. For purposes of ready portability and storage, the mast 14 and boom 20 can also be provided in sections which can be separated for compact storage.

Turning to FIG. 3, there is shown in FIGS. 3*a*, 3*b*, and 3*c*, different alternative embodiments of the curved mounting members 44. Shown are typical forward members for the starboard side. As shown in FIG. 3*a*, the member 44 conforms to approximately 225° of arc in surrounding the inflatable buoyancy tube 60 of the boat 12. Further, and as shown in FIG. 3*a*, the lee or bilge board 24 can be fastened to the member 44 with bolts 54 and wing-nuts 56 although other fasteners can be used. Hinges, (not shown) may also be used so that the board can fold upward in shallow water, allowing the boat to be beached.

In an alternative embodiment, as shown in FIG. 3*b*, a curved mounting member 41 has a curvature more closely approximately 270° of arc, so that the bilge board 26 is not on a tangent to the buoyancy tube 60 but, rather, is somewhat inboard of its outermost part. The corner connector 42 and cross beam strut connector 46 are substantially identical to those in the embodiment of FIG. 3*a*, and are similarly placed.

In FIG. 3*c*, a second alternative embodiment is shown in which only 180° of arc are encompassed by the curved member 44″. In this embodiment, to assure a tight fit, the buoyancy tube 60 should be somewhat overinflated so as to form a tight frictional engagement of the curved member 44″. The change in curvature necessitates a modification of the corner member 42′ as well as shortening of the cross-thwart 52′. The corner member 42′ which, in the other embodiments connects with the curved member 44″ at an angle which places the corner member 42′ somewhat "under" the buoyancy tube 60 now receives the curved member 44″ substantially perpendicular to the plane, of the floor of the boat 12, as defined by the struts 52′ and 40.

Figure 4:
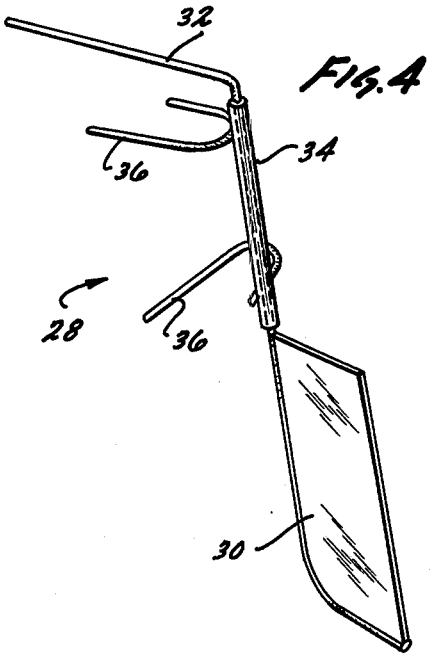
FIG. 4 is a perspective view of a rudder assembly adapted to attach to an inflatable boat according to the present invention.

FIG. 4 shows the rudder assembly 28, apart from the combination. The rudder element 30 is detachably mounted to the portion of the tiller member that passes through the retaining tube 34. For ease in storage, the tiller portion 32 can detach from the remaining parts of the assembly. The rudder blade 30 can also detach from the assembly. In alternative embodiments, (not shown), the rudder blade 30 can also be foldably mounted so that the boat can be easily beached.

Figure 5:
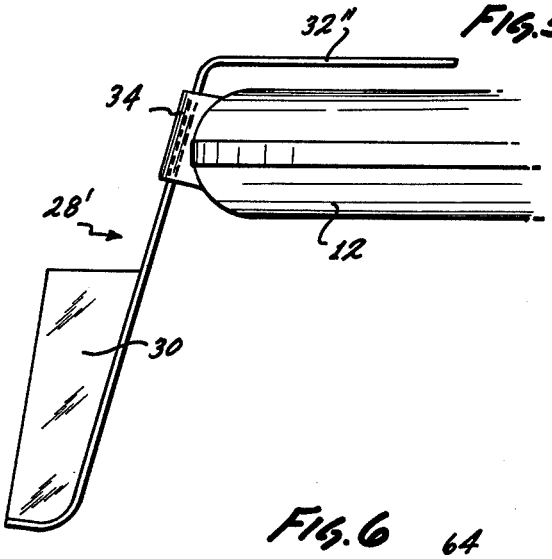
FIG. 5 is a side-view of an alternative rudder assembly.

In FIG. 5 there is illustrated an alternative embodiment of a rudder assembly 28′ in which a support tube member 34′ is integrally mounted on the inflatable boat 12 and is bonded thereto. In this embodiment, the tiller portion 32′ would detach from the upright portion of the rudder assembly so that the assembly could be removed from the boat 12.

Figure 6:
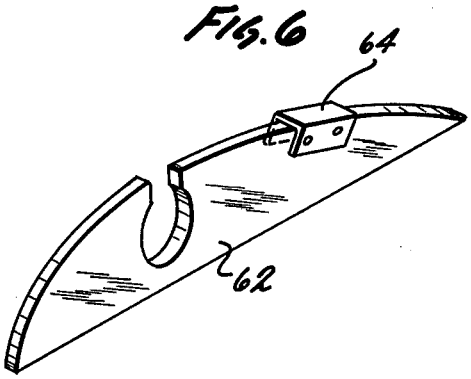
FIG. 6 is a perspective view of a modified oarlock member with a mounting plate attached to receive jib sheet.

FIG. 6 illustrates an alternative embodiment of an oarlock 62 which includes an extended faired portion. A jib or staysail sheet jam is mounted to the oarlock 62 so that the jib or staysail 18 can easily be set for running.

Figure 7:
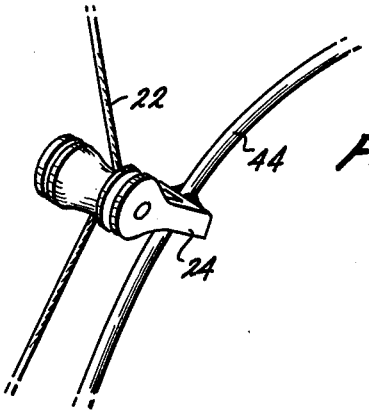
FIG. 7 is a detailed sectional view of a pulley attached to the mounting frame to receive a running line.

FIG. 7 illustrates in detail the block 24 which receives the sheet which controls the boom 20. A conventional pulley is provided so that the mainsail can be handled from any convenient point in the boat.

Figure 8:
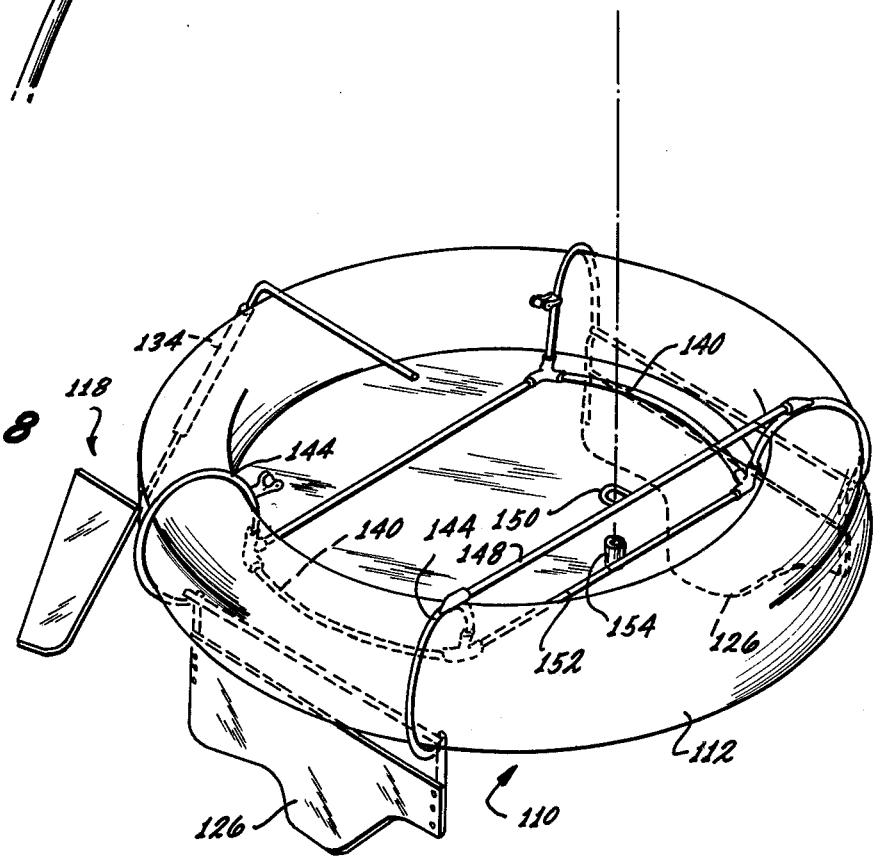
FIG.8 is a perspective view of a sailing cradle of the present invention adapted to mount on a circular inflatable raft.

Turning next to FIG. 8, there is illustrated an adaptation of the present invention for use with a circular or polygonal inflatable boat, which designs have recently been utilized for lift rafts. While the raft of the drawing is shown as round, it is clear that the frame of the present invention could be adapted for virtually any shape of inflatable boat. A modified sailing frame 110 is adapted to mount on an inflatable raft 112. Provision is made for a fully assembled mast (not shown) having a mainsail and a boom which may or may not be included in the kit. Bilge board assemblies 126 give the otherwise circular inflatable raft 112 directional stability so that the raft can be guided through the use of a rudder assembly 118. As illustrated, the rudder assembly 118 is mounted to the raft by a tube 134 which can be an integral part of the inflatable structure.

In this embodiment, a pair of curved struts 140 are mounted in fore and aft relationship to space the curved mounting members 144 and provide a degree of structural integrity to the combination. The forward cross-beam strut 152 is provided with a mast receiving cup 154 and an upper stiffening member 148 is provided with a guide element 150 which aligns the mast and keeps it upright.

In all respects, the sailing frame 110 is substantially similar to the sailing frame 10 which is intended to fit on an inflatable boat 12 rather than an inflatable "raft" 112. However, the frame 110 when disassembled can be packed in substantially the same container that would house the deflated raft and the associated equipment and/or supplies that are furnished with a raft for emergency use.

Such a frame would not add substantial weight to the raft package itself, and would, of course, be invaluable if drifting aimlessly which is more hazardous than setting a course and attempting to maintain headway in the presence of winds.

Figure 9:
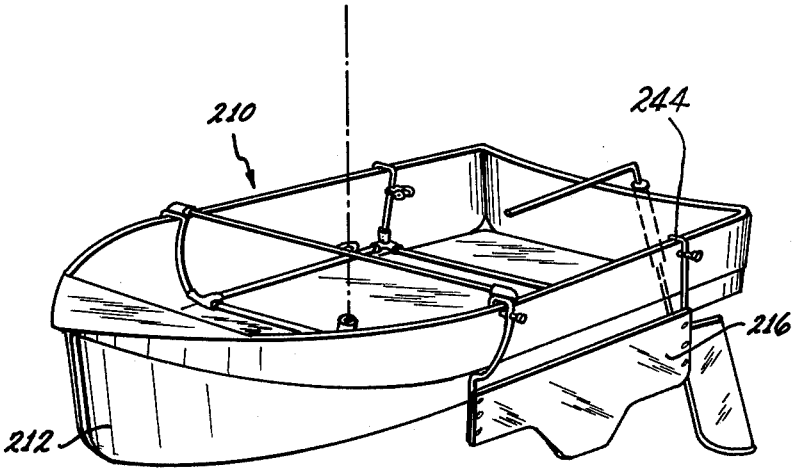
FIG. 9 is a perspective view of the sailing cradle of the present invention as adapted to mount on a substantially rigid boat.

Turning next to FIG. 9, there is shown an embodiment of the present sailing frame 210 that is adapted to be fitted to a rigid craft such as a row boat 212. This adaptation permits owners of light, rigid craft to sail such craft, much in the fashion of the smaller class boats such as the Sabot and others. While the strength and structural rigidity of the boat 212 is such that the complete frame is not essential, it does appear that the retention of the integral frame structure distributes the weight and stresses of the sailing apparatus relative to the boat hull.

This sailing frame embodiment is substantially similar to the preferred embodiment of FIGS. 1 and 2 except that the curved mounting members 44 are modified and shaped appropriately to the hull upon which the frame 210 is to be mounted. In the simplest embodiment, a simple, U-shaped member 244 can be provided with clamping elements to that the gunwales can be gripped by the frame to prevent relative motion.

The similar parts of this embodiment have been given similar reference numerals in the 200-series, so that, for example, the bilge board 26 of FIG. 1 finds its counterpart in the bilge board 226 of FIG. 9.

Figure 10:
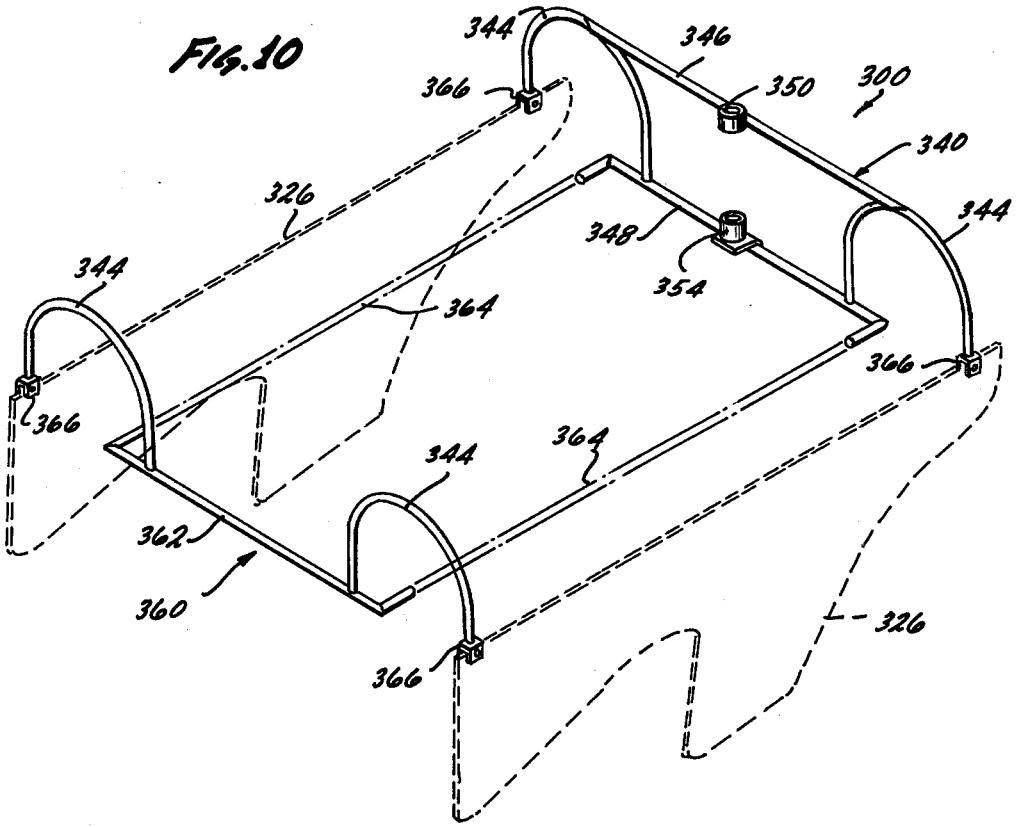
FIG. 10 is a perspective view of an alternative embodiment of the sailing cradle utilizing the curved membersn of FIG. *3c;*

In FIG. 10, there is shown an alternative cradle 300 whose mounting members are similar to those illustrated in FIG. 3c. The embodiment of FIG. 10, however, includes larger subassemblies and does not disassemble into as many parts as, for example, the embodiment of FIG. 2.

The modified sailing cradle 300 of FIG. 10 includes a forward, mast support frame assembly 340 which includes, as an integral group, the curved mounting members 344, an upper stiffening member 346 and a lower stiffening member 348. An upper mast mounting guide 350 is connected to the upper stiffening member 346. A mast mounting cup 354 is fastened to the lower cross member 348.

The after support frame 360 includes an integral assembly of curved mounting members 344 fastened to a lower stiffening cross member 362. A pair of longitudinal struts 364 are adapted to connect the aft support frame 360 to the mast support frame 340. Bilge boards 326 are fastened to the support members 344 through the use of a yoke 366 that is apertured to receive a bolt or wing nut assembly.

Figure 11:
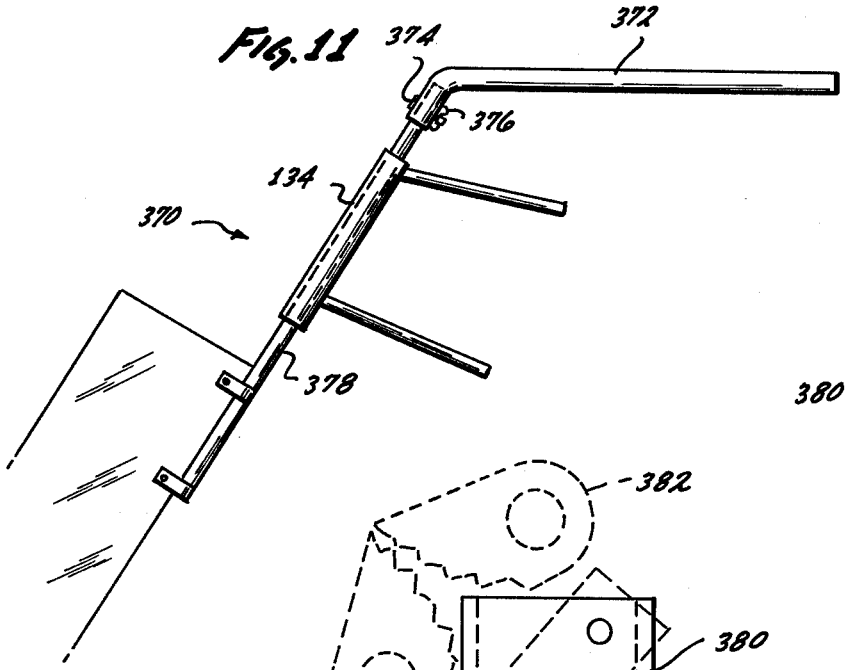
FIG.11 is a side view of an alternative rudder assembly adapted to attach to the motor mounting beckets.

FIG. 11 shows an alternative rudder assembly 370 in which the tiller 372 includes an integral nut 374 that cooperates with a winged bolt 376 to couple the tiller 372 to the rudder rod 378. The attachment tube 134 of FIG. 4 can be utilized here to fit in the outboard motor beckets.

Figure 12:
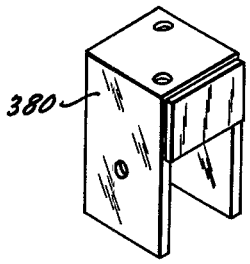
FIG. 12 is a perspective view of a mounting bracket for a jib sheet jam.
Figure 13:
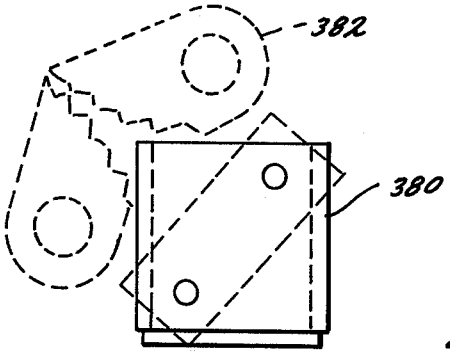
FIG. 13 is a top view of the bracket of FIG. 12 showing a jib sheet jam, in phantom, mounted thereon.

Finally, a modified attachment for the jib sheet stay jam is shown in FIGS. 12 and 13. The mounting block 380 of FIG. 12 is intended to attach to the oarlock 62 of the inflatable boat, as in FIG. 6. The difference is that the block 380 is adapted to extend above the oarlock to receive a jib sheet jam 382, shown in phantom, in FIG. 13.

In summary, there has been disclosed and described in detail, a disassemblable sailing frame or cradle which, in the preferred embodiment, is adapted to combine with an inflatable craft so that the inflatable craft becomes a sailing boat. The frame provides a structural integrity, independent of the inflatable boat and is adapted to mount on the buoyancy tube which may be considered the gunwale. Lee or bilge boards provide fore and aft stability and a rudder assembly is adapted to mount to the transom or such other area as could be utilized for mounting an outboard motor. The forward structural cross-members provide a mounting for a mast and include a guide element and a mounting cup, which carries and distributes the load of the mast.

In addition to the other elements of the frame, sailing hardware such as blocks and jams are provided to cooperate with sheets and lines so that adequate control can be maintained of a mainsail. Where appropriate, a jib or a stay sail can also be provided.

The rudder, bilge boards, mounting members, struts, cross-members and mast and boom can all be disassembled into a relatively small bundle of parts, which need not occupy much more volume than the deflated boat itself.

What is claimed as new is:

1. For use in combination with a boat having gunwales, a sailing cradle adapted to be supported by the boat, said sailing cradle comprising:

(a) a first frame member adapted to mount over a first gunwale;

(b) a second frame member adapted to mount over a second gunwale, substantially opposite the first gunwale;

(c) first and second athwartship, connecting members, one being adapted to ride at the floor of the boat athwartship, both joining said first and second frame members;

(d) mast receiving means in said first and second connecting members; and (e) at least one board member affixed to said first frame member outboard the gunwale and extending substantially below the water line to provide resistance to lateral motion of the boat, the cradle providing the structural rigidity to the combination necessary for sailing, with the boat merely furnishing the necessary buoyancy to the combination.

2. The combination of claim 1, above, including a second board member affixed to said second frame member outboard the gunwale and extending substantially below the water line to provide resistance to lateral motion of the boat.

3. The combination of claim 2, above, including third and fourth frame members adapted to mount over said first gunwales, respectively, said third and fourth members being affixed to said one and second board members, respectively, near the aft ends thereof; and longitudinal strut members for connecting said first and third connecting members and said second and fourth connecting members, respectively, at the floor of said boat.

4. For use in combination with an inflatable boat having buoyancy tubes and motor mounting beckets, a sailing cradle comprising:

(a) first and second frame members adapted to partially enclose the buoyancy tubes forming the sides of the boat; said frame members being secured in place when the buoyancy tubes are inflated;

(b) first and second forward cross members rigidly interconnecting said first and second frame members athwartship;

(c) mast receiving means in said forward cross members; and (d) at least one board fastened to a frame member outboard said buoyancy tubes and adapted to extend below the water line to provide resistance to lateral movement of the boat, said cradle providing structural rigidity to the combination adequate for sailing.

5. The combination of claim 4 further comprising a mast member in said mast receiving means, and means for attaching halyards of a sail hoisted on said mast.

6. The combination of claim 4 further comprising a rudder assembly adapted to mount in the motor mounting beckets.

7. The combination of claim 4 further comprising a second board fastened to the opposite said frame member and outboard from said corresponding buoyancy tube and adapted to extend below the water line, said first and said second boards fastened to respective frame members positioned on opposite sides of the inflatable boat.

8. The combination of claim 4 further including third and fourth frame members adapted to partially enclose the buoyancy tubes forming the sides of the boat;

(a) an after athwartships cross member, connecting said third and fourth frame members at the floor;

(b) a second board fastened to the frame members opposite said one board, each of said boards being supported by two of said frame members; and (c) first and second struts connecting the forward and aft frame members on the same side of the boat at the floor into a substantially rectangular frame to impart additional structural rigidity to the cradle.

9. A kit of disassembled components adapted when assembled to form a sailing combination for an inflatable boat having buoyancy tubes, comprising:

(a) a forward cradle member including port and starboard buoyance tube enclosing elements and upper and lower athwartships cross members having mast receiving means;

(b) port and starboard strut members positioned to ride at the floor of the boat and adapted to connect said forward cradle member in a sailing cradle.

10. The kit of claim 9, further including port and starboard boards adapted to be connected to said cradle member outboard the buoyancy tubes, said boards when connected extending below the water line.

11. The kit of claim 9, further including a mast assembly comprised of telescoped sections adapted to be mounted in said mast receiving means.

12. The kit of claim 9, further including a rudder assembly including a blade and tiller portion, and means for mounting in beckets.

13. The kit of claim 9, further including sails and running gear adapted to be carried by the mast assembly and cradle members including stay jams adapted to be mounted on oarlocks.

14. The kit of claim 9, further including an aft athwartship member adapted to ride at the floor of the boat, connecting said port and starboard strut members into a rigid sailing cradle.

* * * * *